US010526102B2

(12) United States Patent
Herzog

(10) Patent No.: US 10,526,102 B2
(45) Date of Patent: Jan. 7, 2020

(54) CAP STABILIZER FOR CAPPING DEVICE

(76) Inventor: Kenneth J. Herzog, Hampton Bays, NY (US)

( * ) Notice: Subject to any disclaimer, the term of this patent is extended or adjusted under 35 U.S.C. 154(b) by 1570 days.

(21) Appl. No.: 13/488,951

(22) Filed: Jun. 5, 2012

(65) Prior Publication Data

US 2013/0318920 A1 Dec. 5, 2013

(51) Int. Cl.
*B65B 59/04* (2006.01)
*B65B 7/28* (2006.01)

(52) U.S. Cl.
CPC ..... *B65B 59/04* (2013.01); *B65B 7/28* (2013.01); *B65B 7/2807* (2013.01)

(58) Field of Classification Search
CPC ..... B65B 7/2807; B65B 7/2842; B67B 3/00; B67B 3/06; B67B 3/0645
See application file for complete search history.

(56) References Cited

U.S. PATENT DOCUMENTS

| | | | | |
|---|---|---|---|---|
| 2,954,874 | A * | 10/1960 | Rouse | 211/85.9 |
| 4,594,838 | A * | 6/1986 | Ficken et al. | 53/471 |
| 5,050,369 | A * | 9/1991 | Fiwek et al. | 53/471 |
| 6,994,564 | B1 * | 2/2006 | Kan | 439/63 |
| 7,735,297 | B2 * | 6/2010 | Monti | 53/329 |
| 8,028,816 | B1 * | 10/2011 | Smith et al. | 198/457.01 |
| 2003/0115836 | A1 * | 6/2003 | Suzuki et al. | 53/435 |

* cited by examiner

*Primary Examiner* — Christopher R Harmon
(74) *Attorney, Agent, or Firm* — Amster, Rothstein & Ebenstein LLP

(57) ABSTRACT

A cap stabilizer of a capping device includes a fastening element that connects the cap stabilizer to the capping device such that the cap stabilizer is removable from the capping device by sliding the cap stabilizer in a first direction, opposite a direction of travel of container to be capped by the capping device.

16 Claims, 4 Drawing Sheets

CAP STABILIZER FOR CAPPING DEVICE

BACKGROUND

Field of the Disclosure

The present disclosure relates to a cap stabilizer device for use in a capping device that can be easily removed and replaced without tools.

Related Art

Capping devices are used to affix caps to bottles or other containers. These devices may be incorporated into larger bottling or packing machines or may be stand alone devices. Prior to securing the cap to a bottle or other container, the cap is positioned on a top of the bottle, or other container, and aligned for secure capping. A cap stabilizer is provided prior to the capping element to ensure that the cap is properly positioned and aligned for securing. Different size and style stabilizers are used for different size and style caps, and thus, it is common to change the cap stabilizer to accommodate a different cap size or style.

Conventionally, the cap stabilizer is mounted on the capping device with screws. These screws must be removed in order to replace the stabilizer. This requires tools, which are sometimes difficult to position due to the other elements of the machine. That is, the screws may be positioned in an area that is inaccessible by tools. Further, each screw must be individually removed, or at least loosened, in order to allow substitution of the stabilizer. This is inconvenient and time consuming.

Accordingly, it would be desirable to provide a cap stabilizer for a capping device that avoids these and other problems.

SUMMARY

It is an object of the present disclosure to provide a cap stabilizer for a capping device that is easily removed and replaced without tools.

A cap stabilizer for use in a capping device with a cap stabilizer mounting element in accordance with an embodiment of the present disclosure includes at least one fastening element configured to connect the cap stabilizer to the cap stabilizer mounting element such that the cap stabilizer is removable from the cap stabilizer mounting element by sliding the cap stabilizer in a first direction.

A capping device in accordance with an embodiment of the present disclosure includes a conveyer operable to move containers through the capping device in a first direction, a capping element operable to secure a cap to at least one container as it moves through the capping device and a cap stabilizer positioned just upstream of the capping element and mounted on a mounting element, the cap stabilizer configured to align the cap on at least one container before it reaches the capping element. The cap stabilizer further includes at least one fastening element configured to connect the cap stabilizer to the mounting element such that the cap stabilizer is removable from the mounting element by sliding the cap stabilizer in a second direction, opposite the first direction.

Other features and advantages of the present invention will become apparent from the following description of the invention which refers to the accompanying drawings.

DETAILED DESCRIPTION OF THE EMBODIMENTS

Figure 1:
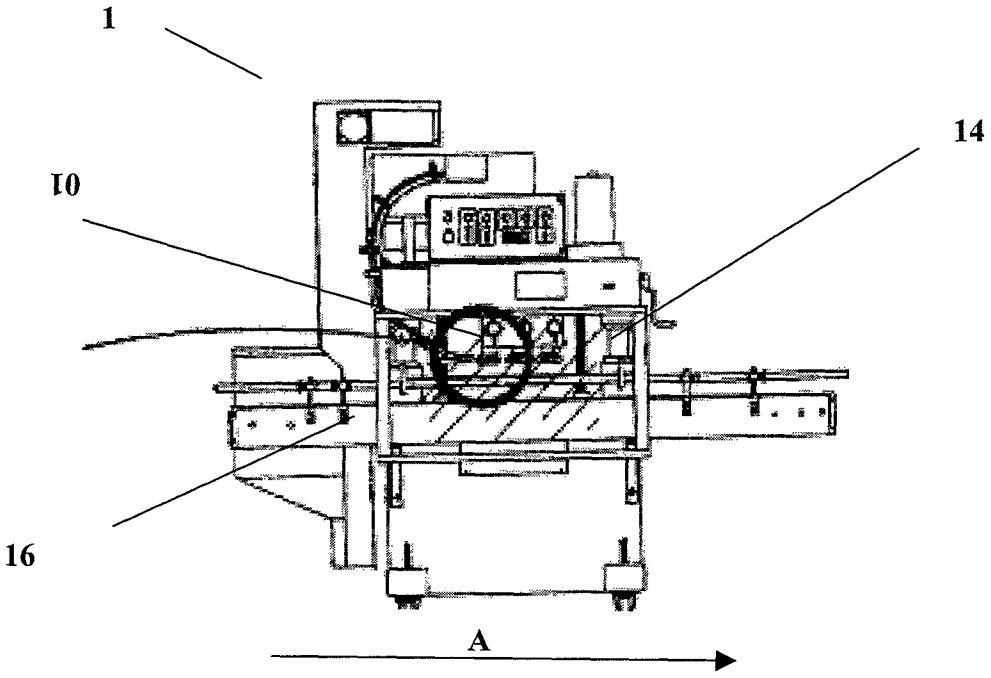
FIG. 1 is an exemplary illustration of capping device including a cap stabilizer in accordance with an embodiment of the present disclosure.
Figure 1A:
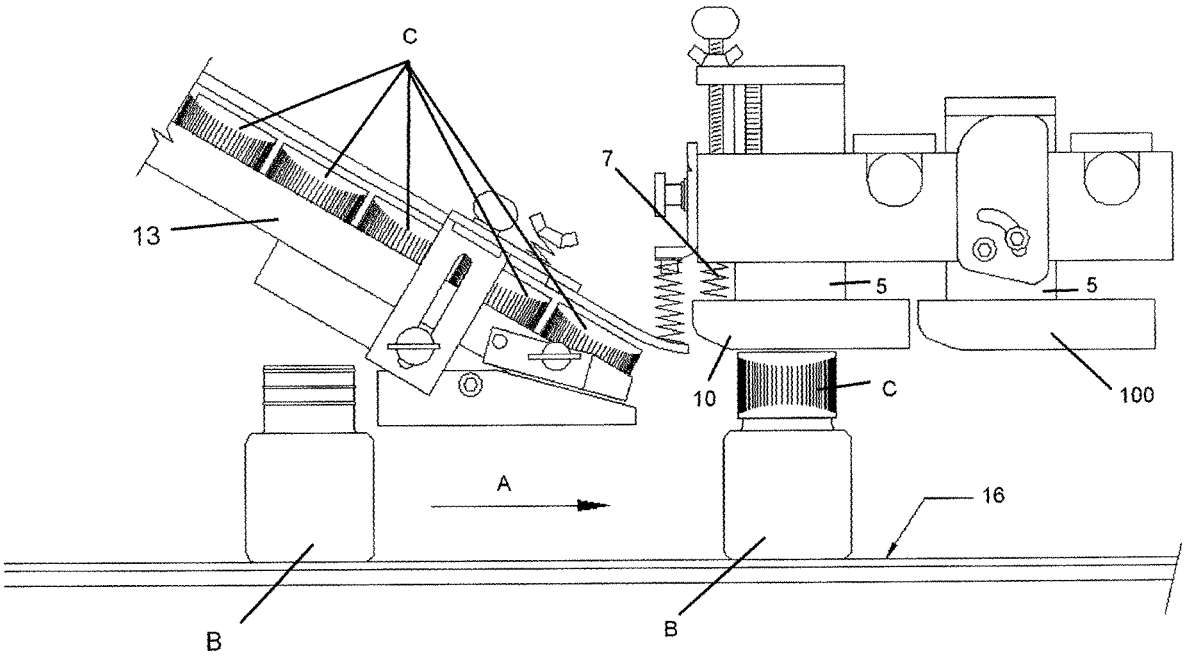
FIG. 1A is a more detailed view of a portion of the capping device of FIG. 1 including the cap stabilizer in accordance with an embodiment of the present disclosure.

FIGS. 1 and 1A illustrate an exemplary embodiment of a capping device 1 including a cap stabilizer 10, 100 in accordance with an embodiment of the present disclosure. The stabilizer 10, 100 is positioned just upstream of capping element 14 which is configured to secure a cap to a bottle or other container as it passes through the device 1. Bottles B, or other containers, travel through the device 1 in the direction of arrow A. As used herein, the words "bottle" or "bottles" refer to any type of container that is capped by the capping device 1. The bottles B typically travel on a conveyor 16, however, any suitable means for advancing the bottles B or container may be used. As the bottles B, or other containers, approach the stabilizer 10, 100 caps C are provided via a cap chute 13 from the cap feeder. The caps C are positioned on the top of the bottle B or other container. The stabilizer 10, 100 properly positions and aligns the cap C on the bottle B so that it can be secured in place by the capping element 14.

The cap stabilizer 10, 100 is preferably secured to the device 1 via a mounting element 5 positioned at a predetermined position relative to the capping element 14. A predetermined space is provided under the stabilizer 10, 100 to allow the bottle B, or other container, to pass underneath. An adjustment mechanism may be provided to adjust the relative height of the stabilizer 10, 100 in a conventional manner. Fastening elements 22*a-d* (See FIG. 2) are provided on the stabilizer 10, 100 and/or the mounting element 5 to secure the stabilizer to the capping device 1 in a desired position. The stabilizer 10, 100 is preferably movable up and down relative the rest of the capping device 1. The stabilizer 10, 100 is preferably biased in a downward position, as illustrated in FIG. 1A, for example, by the spring 7. As bottles B pass under the stabilizer 10, 100, the stabilizer 10, 100 and mounting element 5 rise slightly against the biasing force of the spring 7 and then return to the downward position after the bottle passes. If desired, an additional spring may be provided on a rear of stabilizer 10, connected to the plate 22*d* discussed below. Further, one or more biasing springs may be provided on the stabilizer 100, as well. The biasing spring 7 may be excluded altogether, if desired.

Figure 2:
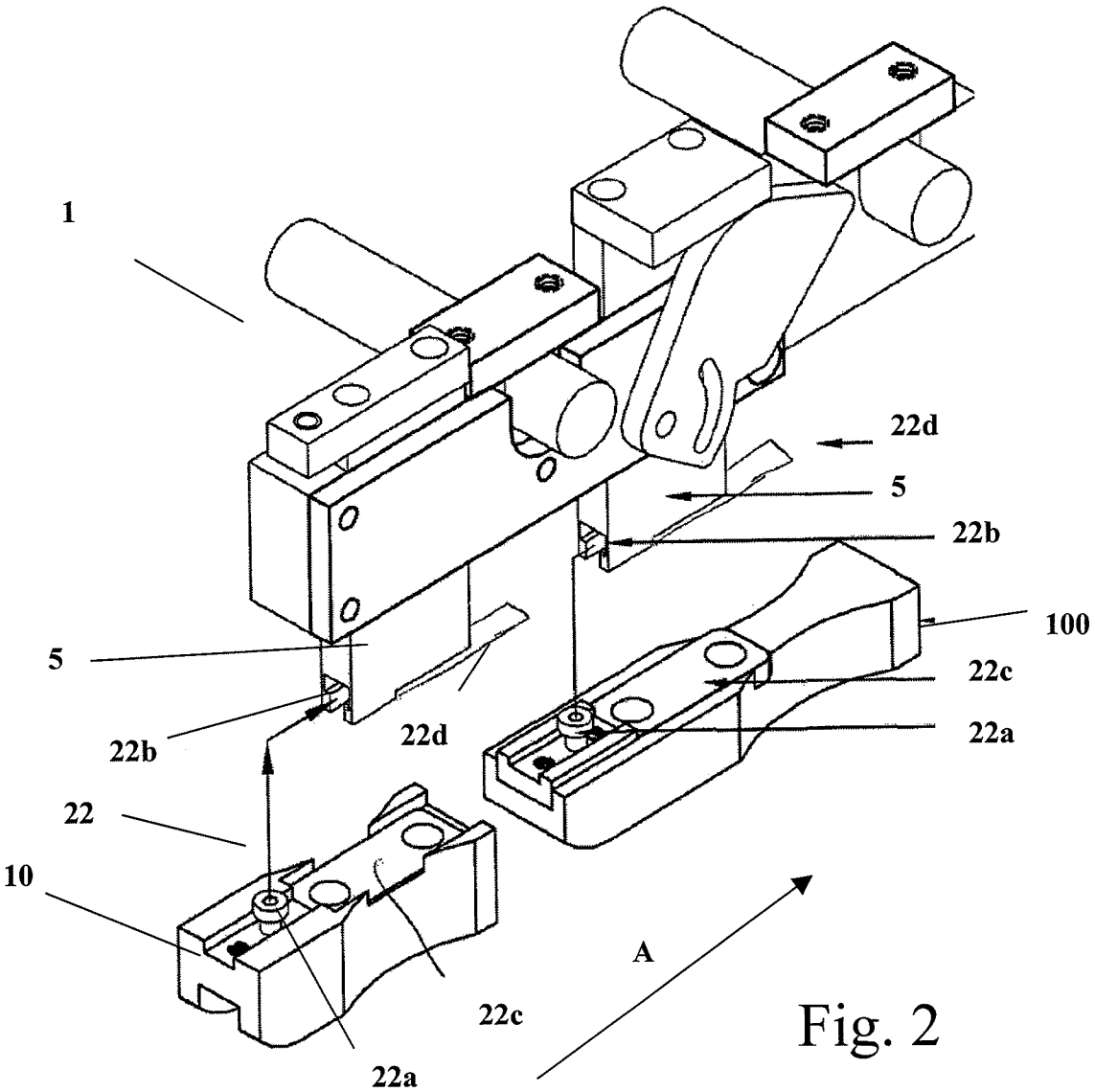
FIG. 2 is a more detailed view of a cap stabilizer in accordance with an embodiment of the present disclosure.

As can be seen in FIG. 2, a protrusion 22*a* extends upward from a top surface of the stabilizer 10. The protrusion 22*a* preferably has a T-shaped cross-section. A locking slot 22*b* is formed in the mounting element 5 and is sized to receive the protrusion 22*a* from a front end of the mounting element. The slot 22*b* has a T-shaped cross-section as well and is slightly larger than the protrusion 22*a* such that the protrusion slides into the slot. The slot 22*b* has a length of approximately ⅛ inch and extends in the direction of arrow A. The length of the slot 22*b* may be slightly longer or shorter provided that it is sufficiently long to maintain stability of the stabilizer 10 and to properly align the magnet 22*c* with the plate 22*d*, as discussed below. The protrusion 22*a* slides into the slot 22*b* in the direction of arrow A. The T-shape of the protrusion 22*a* and slot 22*b* prevents the cap stabilizer 10 from dropping downward, and thus, maintains a height of the stabilizer relative to the container passing underneath. It is noted that the bottles B or other containers travel in the direction of arrow A, such that operation of the device 1 tends to further secure the protrusion 22*a* in the slot 22*b*.

A magnet 22*c* is also provided on a top surface of the stabilizer 10, adjacent to the protrusion 22*a* in the direction of the arrow A. The magnet 22*c* is positioned for interaction with a metal catch plate 22*d* provided on the bottom surface of the mounting element 5 and is operable to help hold the stabilizer 10 in place via the magnetic attraction between the magnet and the metal catch plate. If a second bias spring is used, the second bias spring if preferably positioned on the top surface of the plate 22*d*.

FIGS. 1-2 illustrate two separate stabilizers 10, 100. These two stabilizers 10, 100 are constructed in essentially the same manner except that the stabilizer 100 is longer than the stabilizer 10. It is common, although not required, to include two stabilzers 10, 100 in a single capping device 1. The width of the stabilizer 100 is preferably the same as that of the stabilizer 10. Otherwise, the construction and operation of the stabilizer 100 is essentially the same as that described above with respect to stabilizer 10. Two different mounting elements 5 are illustrated in FIG. 2, however, either cap stabilizer 10, 100 may be connected to either mounting element 5. It is common, however, to position the shorter stabilizer 10 in front of the longer stabilizer 100. In addition, while the two stabilizers 10, 100 are illustrated with a different length, if desired, the two stabilizers may have the same length.

The stabilizer 10, 100 of the present application may be removed from the mounting element 5 without the need of any tools at all. A user need only slide the stabilizer 10, 100 in a direction opposite the arrow A such that the protrusion 22*a* slides out of slot 22*b*. The magnet 22*c* also allows for this sliding movement with minimum resistance such that it will also slide out of contact with catch plate 22*d*. Once removed, the stabilizer 10, 100 can be easily replaced, also without the need for tools. The replacement stabilizer slides back into place in the direction of arrow A also without the need for any tools.

Figure 3:
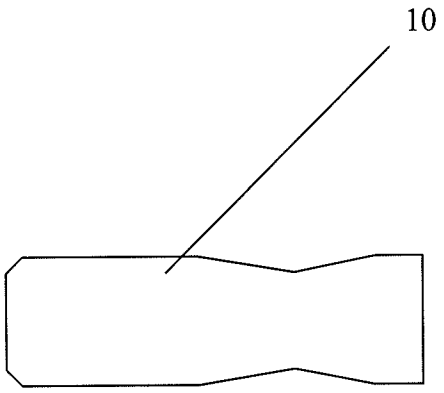
FIG. 3 is a bottom view of the cap stabilizer of FIG. 2.

The end of the stabilizer 10 facing the bottles B as they approach the stabilizer is preferably somewhat rounded. This reduces wear and tear on the caps C as they contact the stabilizer. In addition, the bottom surface of the stabilizer, as can be seen in FIG. 3, for example, is substantially smooth as well, also to reduce wear and tear on the caps as they contact the stabilizer 10 and pass underneath it.

Although the present invention has been described in relation to particular embodiments thereof, many other variations and modifications and other uses will become apparent to those skilled in the art.

What is claimed is:

1. A cap stabilizer for use in a capping device including a cap stabilizer mounting element, the cap stabilizer comprising:

at least one fastening element configured to connect the cap stabilizer to the cap stabilizer mounting element such that the cap stabilizer is removable from the cap stabilizer mounting element by sliding the cap stabilizer in a first direction, wherein the cap stabilizer has a longitudinal axis aligned with a direction of travel of containers in the capping device, and wherein the first direction is a direction opposite that of the direction of travel of the containers in the capping device, wherein the cap stabilizer is configured to mount caps on the containers in a vertical direction.

2. The cap stabilizer of claim 1, wherein the at least one fastening mechanism comprises:

a protrusion formed on a top surface of the cap stabilizer; and a slot, formed in the cap stabilizer mounting element and configured to receive the protrusion and allow the protrusion to slide therein, the slot extending in a second direction, opposite the first direction.

3. The cap stabilizer of claim 2, wherein the slot has a length of approximately ⅛ inch.

4. The cap stabilizer of claim 2, wherein the protrusion has a T-shaped cross-section.

5. The cap stabilizer of claim 4, wherein the slot has a T-shaped cross-section and is slightly larger than the protrusion.

6. The cap stabilizer of claim 2, wherein the fastening device further comprises:

a magnet positioned on the top surface of the cap stabilizer adjacent to the slot in the second direction; and a metal catch plate, positioned on a bottom surface of the cap stabilizer mounting element adjacent to the slot in the second direction, such that the magnet connects with the metal catch plate when the protrusion is received in the slot.

7. The cap stabilizer of claim 2, wherein the second direction is the direction of travel of containers in the capping device.

8. The cap stabilizer of claim 1, wherein the cap stabilizer and the cap stabilizer mounting element are movable upward and downward in the capping device, the cap stabilizer further comprising a bias spring configured to bias the cap stabilizer in a downward position.

9. A capping device for capping containers, the capping device comprising:

a conveyer operable to move containers through the capping device in a first direction;

a capping element operable to secure a cap to at least one container as it moves through the capping device; and a cap stabilizer positioned just upstream of the capping element and mounted on a mounting element, the cap stabilizer configured to align the cap on the at least one container before the container reaches the capping element;

the cap stabilizer further comprising:

at least one fastening element configured to connect the cap stabilizer to the mounting element such that the cap stabilizer is removable from the mounting element by sliding the cap stabilizer in a second direction, opposite the first direction, wherein the cap stabilizer is configured to mount caps on the containers in a vertical direction.

10. The capping device of claim 9, wherein the at least one fastening mechanism comprises:

a protrusion formed on a top surface of the cap stabilizer; and a slot, formed in the mounting element and configured to receive the protrusion and allow the protrusion to slide therein in the first direction.

11. The capping device of claim 10, wherein the slot has a length of ⅛ inch.

12. The capping device of claim 10, wherein the protrusion has a T-shaped cross-section.

13. The capping device of claim 12, wherein the slot has a T-shaped cross-section and is slightly larger than the protrusion.

14. The capping device of claim 10, wherein the fastening device further comprises:

a magnet positioned on the top surface of the cap stabilizer adjacent to the slot in the first direction; and a metal catch plate, positioned on a bottom surface of the mounting element adjacent to the slot in the first direction, such that the magnet connects with the metal catch plate when the protrusion is received in the slot.

15. The capping device of claim 9, wherein the cap stabilizer and mounting element are movable upward and downward in the capping device, the cap stabilizer further comprising a bias spring configured to bias the cap stabilizer in a downward position.

16. The cap stabilizer of claim 1, wherein the cap stabilizer is configured to be connected to the cap stabilizer mounting element during an entire operation of cap mounting onto the containers.

* * * * *